US005289193A

United States Patent [19]

Lenormand et al.

[11] Patent Number: 5,289,193

[45] Date of Patent: Feb. 22, 1994

[54] RECONFIGURABLE TRANSMISSION ANTENNA

[75] Inventors: Régis Lenormand, Blagnac; Didier Réné; Christian Rigal, both of Toulouse, all of France

[73] Assignee: Alcatel Espace, Courbevoie, France

[21] Appl. No.: 61,425

[22] Filed: Feb. 4, 1993

Related U.S. Application Data

[63] Continuation of Ser. No. 798,955, Nov. 27, 1991, abandoned.

[30] Foreign Application Priority Data

Nov. 29, 1990 [FR] France ..... 90 14941

[51] Int. Cl.[5] ..... H01Q 3/02; H01Q 3/22

[52] U.S. Cl. ..... 342/374; 342/373

[58] Field of Search ..... 342/371, 372, 373, 374, 342/367

[56] References Cited

U.S. PATENT DOCUMENTS

| | | | |
|---|---|---|---|
| 4,286,267 | 8/1981 | Schwierz | 342/374 |
| 4,553,146 | 11/1985 | Butler | 342/379 |
| 4,901,085 | 2/1990 | Spring et al. | 342/373 |
| 4,965,587 | 10/1990 | Lenormand et al. | 342/372 |
| 4,965,588 | 10/1990 | Lenormand et al. | 342/372 |
| 5,115,248 | 5/1992 | Roederer | 342/373 |

FOREIGN PATENT DOCUMENTS

| | | | |
|---|---|---|---|
| 0333166 | 9/1989 | European Pat. Off. | H01Q 25/00 |
| 2813916 | 10/1980 | Fed. Rep. of Germany | H01Q 3/24 |
| 2368836 | 5/1978 | France | H04B 7/15 |

OTHER PUBLICATIONS

Electronic Engineering vol. 61, No. 748, Apr. 1989, pp. S22-S27, Woolwich, London, GB; F. Rispoli: "Reconfigurable satellite antennas: a review".

*Primary Examiner*—Gregory C. Issing

*Attorney, Agent, or Firm*—Sughrue, Mion, Zinn, Macpeak & Seas

[57] ABSTRACT

The invention relates to a reconfigurable transmission antenna comprising a reflector (10) for energy focussing, and an array (11) of source elements situated in the focal region of the reflector, so that the electromagnetic field is synthesized in said region, wherein a spot (SPi) is the result of radiation from a number of sources that is fixed and identical for all the spots; any one source participating at any one time in radiating one spot at the most, and high-level switching being used to reconfigure the spots by selecting the sources that participate in a given spot. Application to the space telecommunications field in particular.

6 Claims, 4 Drawing Sheets

SP1
SP2
SP1'
SP2'
FILTERS
25
SWITCHING MATRIX
24
COUPLER
22
23
21
20
DIVIDER
26
18
28
27
E1
E2
S'

RECONFIGURABLE TRANSMISSION ANTENNA

This is a continuation of application No. 07/798,955 filed Nov. 27, 1991 now abandoned.

BACKGROUND OF THE INVENTION

The invention relates to a multi-access multi-spot reconfigurable transmission antenna.

In the general case of space missions, the trend towards satellite transmissions to low-capacity users requires increasing the reception quality of the on-board equipment. This increase in capacity is obtained by increasing the gains of the on-board antennas, and this has the effect of reducing their coverages.

In order to provide continuity of service, these reductions in coverage require a plurality of beams to be generated. Such multi-spot coverage enables the on-board capacities to be managed better as a function of:

different traffic densities; and of changes in traffic densities over time.

For a satellite system providing world coverage, it is advantageous for it to be possible to replace a satellite that is defective or at the end of its life with a satellite taking up another orbital position. This requires multi-spot coverage that is reconfigurable.

Active antennas of the type having directly radiating arrays or focal arrays solve such problems of coverage reconfigurability and of capacity exchange between spots. However, such antennas suffer from the drawback of being very complex. Furthermore, they only provide limited reconfigurability and power exchange.

French Patent Application number 8803547 filed on Mar. 8, 1988 describes an antenna which provides electronically reconfigurable transmission and which comprises a reflector for energy focussing, an array of source elements situated in the focal region of the reflector, feed and control electronics including first and second generalized couplers disposed on respective sides of a plurality of amplifiers, and beam-forming circuits each corresponding to one transmitted beam; the amplitudes and the relative phases of the signals output by the circuits being controlled respectively by an adjustable attenuator and by an adjustable phase-shifter.

This type of solution suffers from the drawback of having limited reconfigurability for the spots generated by distinct sources or distinct groups of sources.

SUMMARY OF THE INVENTION

An object of the present invention is to provide flexibility in traffic exchange and in reconfiguration, which flexibility is required for the above-mentioned missions, without suffering from the drawbacks of the abovementioned solutions.

To this end, the invention provides a reconfigurable transmission antenna comprising a reflector for energy focussing, and an array of source elements situated in the focal region of the reflector, so that the electromagnetic field is synthesized in said region, said antenna being characterized in that a spot (SPi) is the result of radiation from a number of sources that is fixed and identical for all the spots; any one source participating at any one time in radiating one spot at the most, and in that high-level switching is used to reconfigure the spots by selecting the sources that participate in a given spot.

Advantageously, such an antenna enables power to be exchanged between a plurality of spots with optimum amplification efficiency, while enabling the spots to be reconfigured.

Since each spot is constituted by juxtaposing the beams from n sources (e.g. 3), each of the sources and all the associated connectors are rated for the power transmitted by the spot divided by n.

BRIEF DESCRIPTION OF THE DRAWINGS

The characteristics and advantages of the invention appear from the following description given by way on nonlimiting example, with reference to the accompanying drawings, in which.

DETAILED DESCRIPTION OF THE PREFERRED EMBODIMENTS

Figure 1:
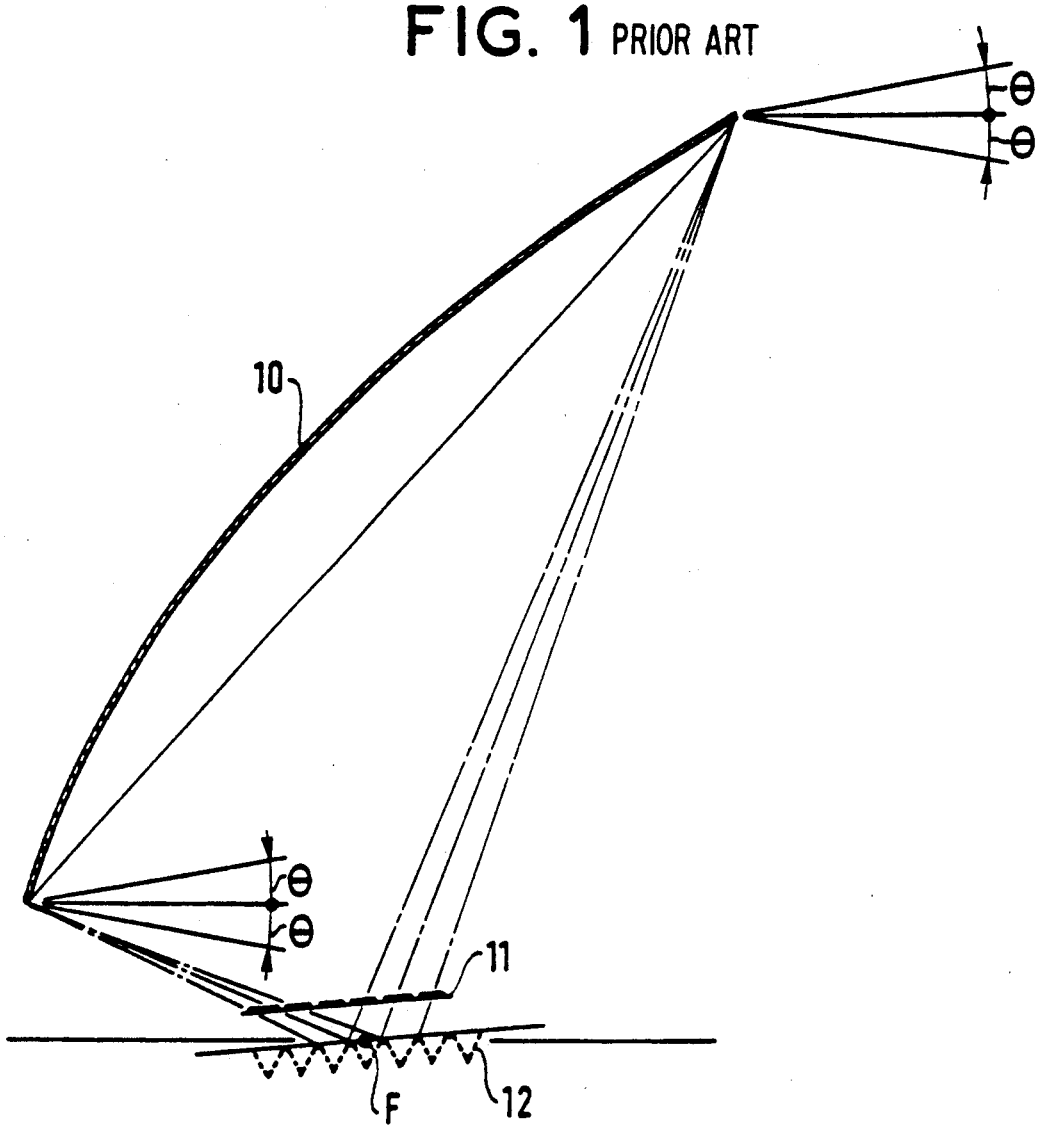
FIG. 1 PRIOR ART
FIG. 1 is a diagram showing a scanning prior art antenna.

The prior art antenna shown in FIG. 1 comprises an eccentric parabolic reflector 10 illuminated by a planar array 11 of sources situated adjacent to the focal point F of the reflector, and an array 12 represents an array of virtual sources corresponding to the planar array 11. In that antenna, only the phase of each source element is adjusted, thereby enabling optimal synthesis of each source element as if it were at the focal point F of the reflector. Such operation provides an antenna whose gain does not depend on the aiming direction, and the reflector 10 and the array 11 of source elements are kept fixed.

When the specified coverage is achieved by using a plurality of spots, the directivity of the antenna is defined by the amount of spot overlap.

In a multi-access multi-spot antenna of the invention, a spot is generated by the radiation from n (e.g. 3) sources situated in a planar array adjacent to the focal point F of the reflector. This number is identical for all the spots, with any one source participating at any one time in radiating one spot at the most.

Figure 2:
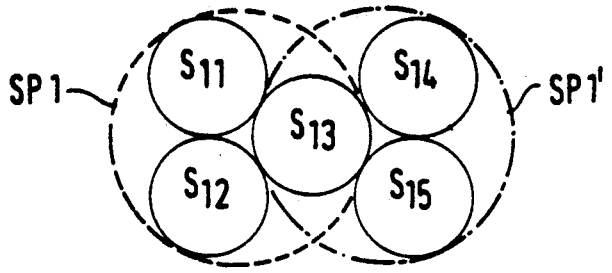
FIG. 2 shows how an antenna of the invention operates.

FIG. 2 shows a spot at two successive instants, i.e. SP1 and SP1', for example with the two spots having a common source $S_{13}$.

Figure 3:
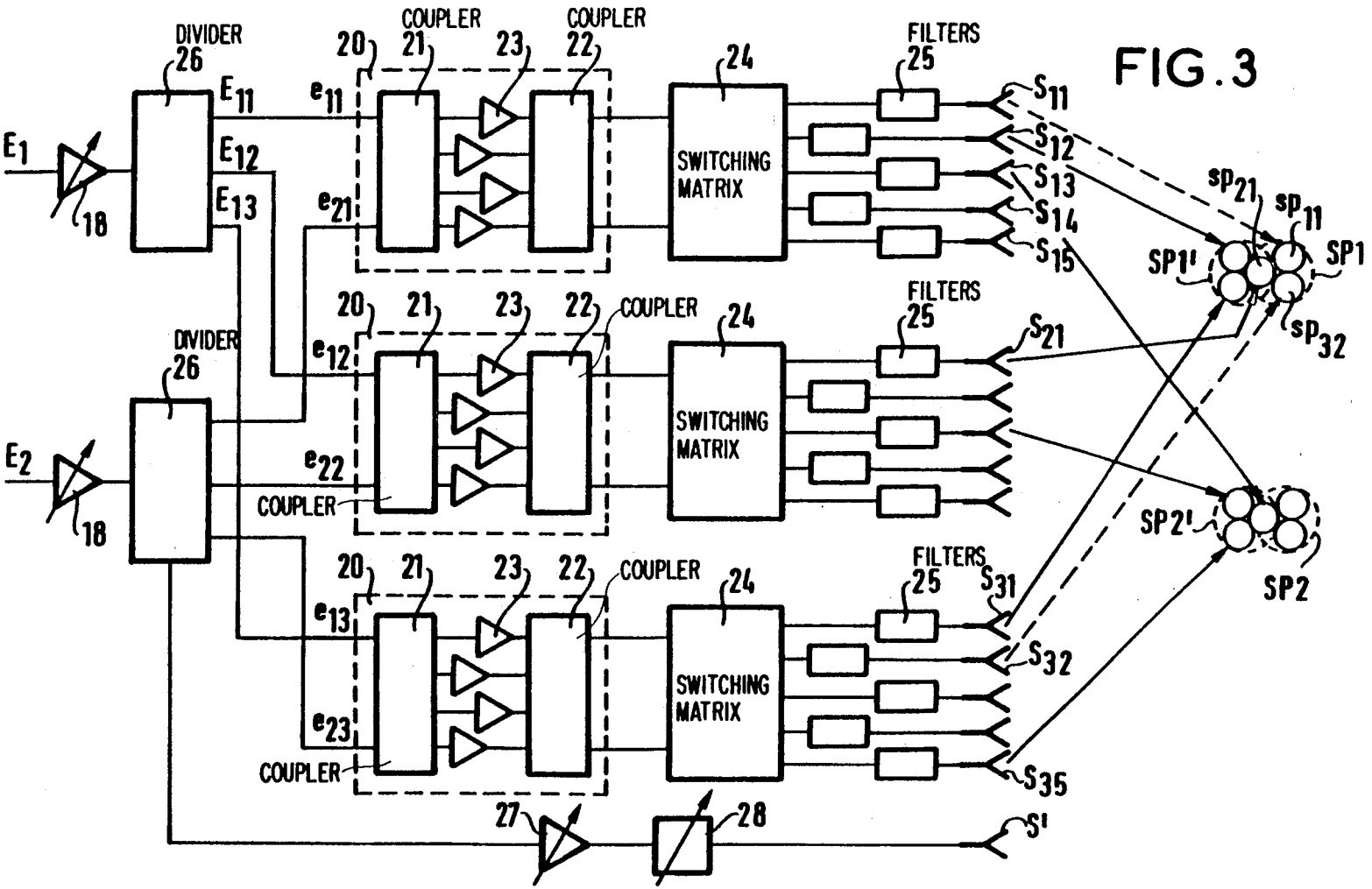
FIGS. 3 to 5 are diagrams showing several embodiments of feed and control electronics for an antenna of the invention.

The following description of FIG. 3 is intended to make the invention easier to understand. To this end, a description is given of the routing and of the radiation of a signal injected at an input $E_1$ of the block diagram of the sub-system of an antenna of the invention.

The signal used by way of example is the signal $E_1$ at the first input of the sub-system. The signal $E_1$ is amplified with an amplification gain that can be controlled by a variable-gain amplifier 18. The amplified signal is divided into three equal-amplitude components $E_{11}$, $E_{12}$, $E_{13}$, in a divider 26. Each of the three components $E_{11}$, $E_{12}$, $E_{13}$ is routed to a respective one of three inputs $e_{11}$, $e_{12}$, $e_{13}$ of three high-power amplification units 20.

The signal $E_{11}$ is divided into four equal-amplitude components by a coupler 21. These components are amplified by four amplifiers 23, they are recombined by a coupler 22, and they are routed to an output $O_{11}$ (Not Shown) of a switching matrix 24.

In identical manner, the components $E_{12}$ and $E_{13}$ are amplified and routed to outputs $O_{21}$ and $O_{32}$.

In this way, the signals $E_{11}$, $E_{12}$, and $E_{13}$ are routed to respective radiating elements $S_{11}$, $S_{21}$, $S_{32}$ via respective switching matrices 24. Radiation of the signals $E_{11}$, $E_{12}$, and $E_{13}$ by the sources $S_{11}$, $S_{21}$, and $S_{32}$ makes up the coverage SP1 by the three spot elements $sp_{11}$, $sp_{21}$, $sp_{32}$.

The coverage may then be changed and, by way of example, for the signal $E_1$, the region of radiation of the antenna, i.e. the coverage SP1, can be changed into a region corresponding to the coverage SP1' ($sp_{12}$, $sp_{21}$, $sp_{31}$) by switching over the respective sources ($S_{11}$, $S_{32}$ to $S_{12}$, $S_{31}$) This switch-over corresponds to reconfiguring two switching matrices 24, with the last matrix not being reconfigured. This antenna reconfiguration does not affect operation of the amplifiers 23.

In multi-spot (SP1, SP2) operation, in identical manner to the above-described operation for a signal injected at the first input of the sub-system, a second signal may be injected simultaneously at a second input without operation being affected for the first signal.

The restriction on the second signal is that it must not use the sources of radiation used for the first signal.

This two-input system having amplifier stages 20 is compatible with two signals radiated simultaneously, only if the sources used by the two signals at a given instant are distinct.

Figure 4:
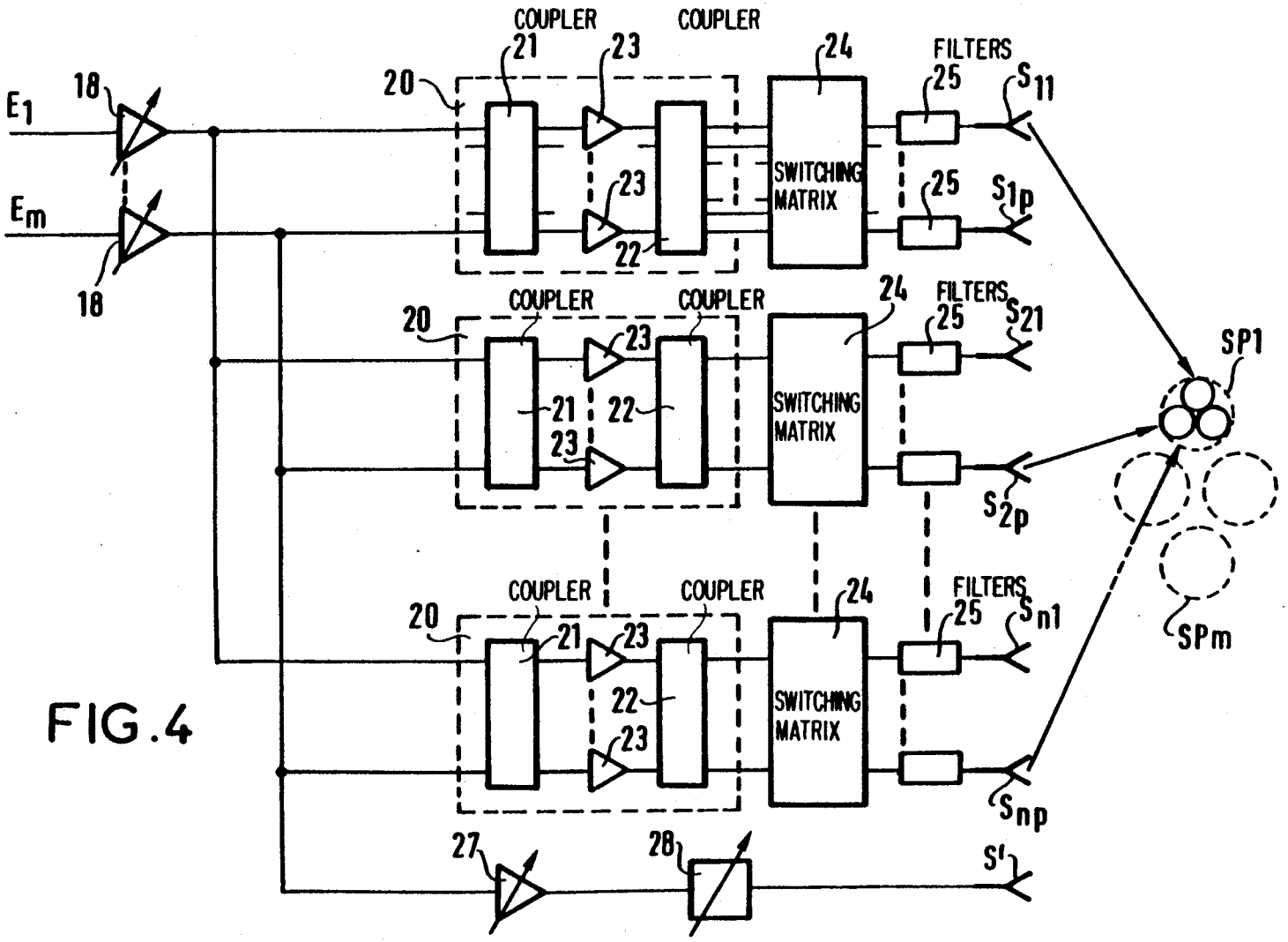

Naturally, it is possible to generalize this concept to m spots. An embodiment of feed and control electronics of such an antenna of the invention, such as shown in FIG. 4, would then include:

- m inputs $E_1$ to $E_m$ corresponding to m spots SP1 to SPm delimiting m coverage areas on the surface of the earth; a variable amplifier 18 being disposed on each one of the inputs;
- a number n of channels, with n corresponding to the number of sources per spot (n=3 in FIG. 3); and on each channel (Vi):
- an amplifier stage 20 having m inputs corresponding to the m inputs $E_1$ to $E_m$ and m outputs, and comprising first and second generalized couplers 21 and 22 disposed on respective sides of f amplifiers 23 disposed in parallel;
- a high-level switching and connection circuit 24 enabling one source element to be made to correspond to each spot SP1 . . . SPm; the circuit being formed of a certain number of fixed links, and of a certain number of switches so as to provide input-output links that are variable over time or otherwise; and
- p filters 25 disposed in series between the p outputs of the circuit 24 and p sources $S_{ij}$ of the array corresponding to the channel Vi.

The amplifier stage 20 comprises first and second generalized couplers 21 and 22, respectively formed of a combination of hybrid couplers, on respective sides of amplifiers 23 so that each input of the first coupler 21 is distributed over all the amplifiers 23. For example, in the amplifier stage 20, a signal applied to the first input is output in amplified form via the first output. In this way, if a signal is applied to one of the inputs of a stage (e.g. ranked i), then at the corresponding output (ranked i), the signal will be amplified by all the amplifiers and no other output will receive the signal at a significant level. At their respective inputs, the power amplifiers 23 each receive a signal from each beam, at an almost identical level. Almost uniform load distribution is obtained over all the inputs of the amplifiers 23. The signals are then reconstituted by means of the second generalized coupler 22 whose structure is the inverse of the structure of the first generalized coupler. The amplifiers 23 thus have constant input power and can operate at their nominal capacity.

This arrangement 20 of hybrid couplers and amplifiers is known to a person skilled in the art as a "multiport amplifier". For this type of amplifier stage, for a constant sum of non-coherent input signal power, the input load of the amplifiers is constant regardless of the distribution of the input signals. Moreover, this distribution is reproduced at stage output.

The number p of sources $S_{ij}$ corresponding to a channel Vi can be no less than the number m of outputs of the amplifier stage 20.

Since each spot SPi is obtained from a constant number n of sources, e.g. 3, these n sources are connected to n "multiport" stages 20 for reasons of non-coherence of the signals in the multiport stages.

Figure 5:
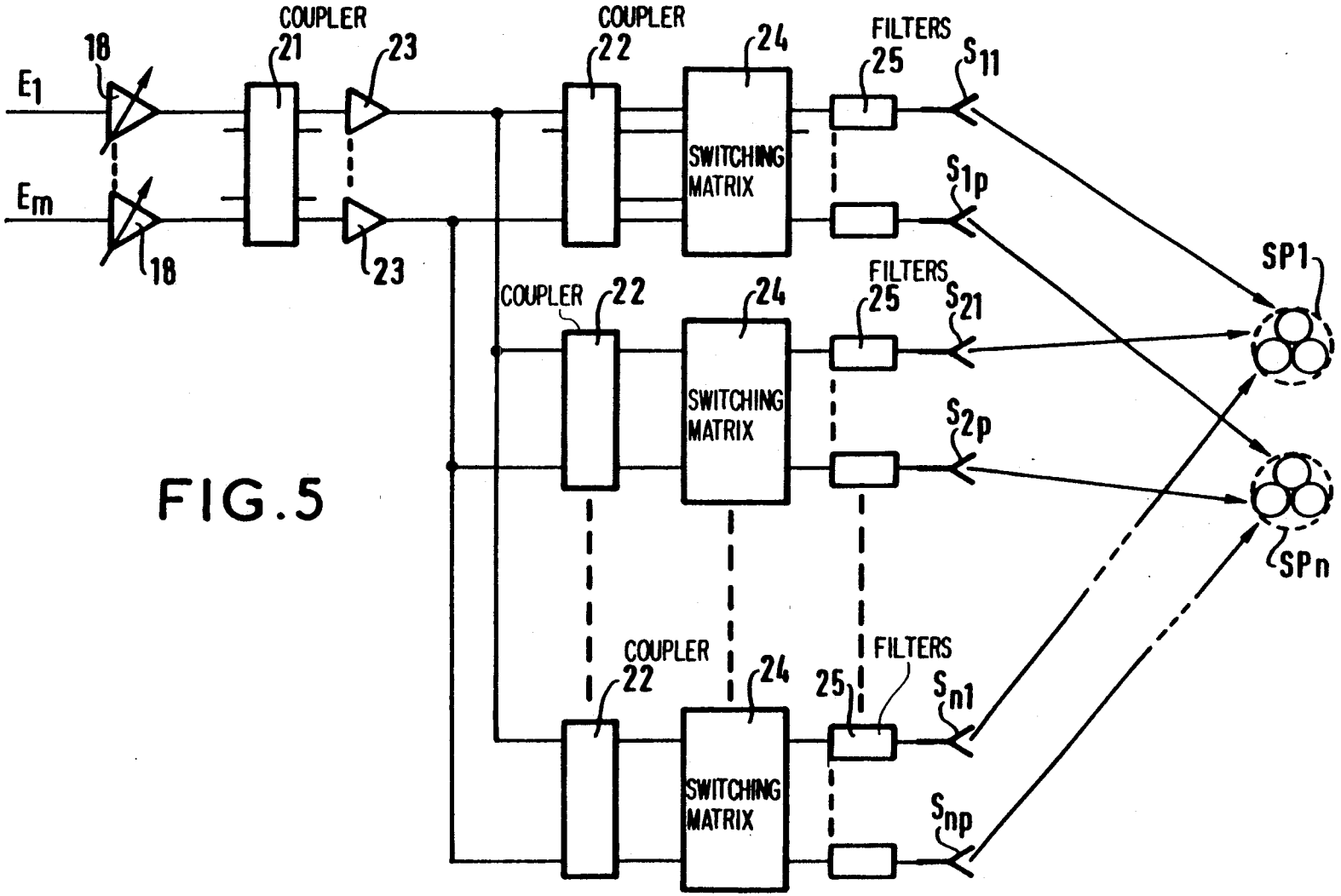

As shown in FIG. 5, all the first couplers 21 can be combined into a single coupler, and consequently, after the amplifiers 23, each amplifier output is divided so as to feed the second couplers 22. In this way, the power rating of the high-power stages is complied with.

One access Ei of spot SPi of the input coupler corresponds to n antenna accesses. The beam corresponding to the spot SPi is radiated by connecting each of the n accesses to the n sources of the primary array corresponding to the coverage to be provided, via the circuit 24 corresponding to a switching matrix. For this spot, coverage is reconfigured by switching over one, two, or n sources. For example, in FIG. 2, with n being equal to three, passing from the spot SP1 to the spot SP1', at two successive instants requires two sources to be switched.

An advantage of such a system is that it provides optimum capacity exchange, i.e. the sum of the power distributed in the spots is equal to the maximum available power, regardless of the relative distribution ratios.

It is necessary to reduce the radiation of a spot over the spots adjacent thereto caused by uniform illumination of the sources.

To solve this problem, the main radiation from the sources is superposed on the radiation from at least one additional isolating source S' as shown in FIG. 4. Such sources S' are positioned in the array so that their radiation can act predominantly in the region to be isolated. Isolation is provided by using a cancelling source S' outside the sources of the switched array. The amplitude (27) and the phase (28) of the cancelling source are adjusted so as obtain energy opposite in phase and identical in amplitude to the source to be cancelled.

In this way, by complying with external relationships such that the energy of the main radiation (n sources) and the radiation from the additional sources are at their minimums in the regions to be isolated, it is possible to meet isolation requirements. The relative main source/isolating source level is generally less than 12 dB, thereby enabling a small portion of the energy of the beam in question to be diverted before the amplifier stage; the fine adjustment of amplitude and phase being provided by the phase-shifter 28 and the variable attenuator 27.

Naturally, the present invention is only described and shown by way of preferred example, and its constituent parts may be replaced by equivalent parts without going beyond the scope of the invention.

We claim:

1. A reconfigurable multi-access multi-spot transmission antenna comprising: a reflector (10) for energy focussing, an array (11) of source elements situated in the focal region of the reflector, so that the electromagnetic field is synthesized in said region, said antenna being characterized in that each spot (SPi) is constituted by juxtaposing a fixed identical number n of beams from n sources; each of the sources delivering the power transmitted by the corresponding spot divided by the number n; any one source participating at any one time in radiating one spot at the most; and in that a matrix high-power amplifier receives input signals to be radiated by said reconfigurable multi-access multi-spot transmission antenna, and outputs corresponding amplified signals to a high-level switching matrix (24) which is provided to reconfigure each spot by selecting the sources that participate in the spot.

2. The antenna according to claim 1, characterized in that said antenna includes feed and control electronics comprising:

m inputs ($E_1$ to $E_m$) corresponding to m spots delimiting m coverage areas on the surface of the earth; a variable amplifier (18) being disposed on each of the inputs; and a number n of channels; n corresponding to the number of sources per spot;

each channel (vi) comprising:

an amplifier stage (20) having m inputs and m outputs;

a high-level switching and connection circuit (24) enabling a plurality of source elements each corresponding to a respective spot (SP1 . . . SPm); and p filters (25) disposed in series between the p outputs of the high-level switching and connection circuit (24) and p sources of the array.

3. The antenna according to claim 2, characterized in that the amplifier stage (20) comprises first and second generalized couplers (21 and 22) disposed on respective sides of amplifiers (23) disposed in parallel, so that a signal applied to the first input is output in amplified form on the first output.

4. The antenna according to claim 3, characterized in that the first and second generalized couplers (21 and 22) are respectively formed of a combination of hybrid couplers (25), so that each input of the first coupler (21) is distributed over all the amplifiers (23) and hence over all the outputs of the hybrid couplers of the first generalized coupler (21), the structure of the second generalized coupler (22) being the inverse of the structure of the first coupler.

5. An antenna according to claim 2 characterized in that said antenna includes at least one additional source (S'), wherein said additional source is an isolating source.

6. The antenna according to claim 2, characterized in that for all channels, said amplifier stage of said antenna only includes a single first generalized coupler (21), and a plurality of amplifiers (23) having respective outputs connected to a corresponding input of n second generalized couplers (22).

* * * * *